US007334322B2

(12) United States Patent
Kameda et al.

(10) Patent No.: US 7,334,322 B2
(45) Date of Patent: Feb. 26, 2008

(54) COUPLING CONDITION DETECTING DEVICE FOR SLIDE FASTENER ELEMENT ROWS

(75) Inventors: Taishin Kameda, Toyama-ken (JP); Satoshi Matsumura, Toyama-ken (JP); Tsuneo Takamura, Toyama-ken (JP)

(73) Assignee: YKK Corporation, Tokyo (JP)

( * ) Notice: Subject to any disclaimer, the term of this patent is extended or adjusted under 35 U.S.C. 154(b) by 332 days.

(21) Appl. No.: 10/828,733

(22) Filed: Apr. 21, 2004

(65) Prior Publication Data

US 2004/0221440 A1 Nov. 11, 2004

(30) Foreign Application Priority Data

May 9, 2003 (JP) ..... 2003-132027

(51) Int. Cl.
*B29D 5/00* (2006.01)

(52) U.S. Cl. ..... 29/766

(58) Field of Classification Search ..... 29/766, 29/33.2, 408, 409, 407.01, 767, 709
See application file for complete search history.

(56) References Cited

U.S. PATENT DOCUMENTS 4,855,592 A * 8/1989 Ogura ..... 356/237.1

FOREIGN PATENT DOCUMENTS

JP 2002-306212 10/2002

* cited by examiner

*Primary Examiner*—John C. Hong
(74) *Attorney, Agent, or Firm*—Alston & Bird LLP

(57) ABSTRACT

This invention relates to a coupling condition detecting device for element rows of a slide fastener. A chain stopping means for stopping a chain at a detecting position of coupling right and left elements adjacent an upstream end of a space in the chain is disposed downstream along a chain carrying direction. A detecting portion having a mechanical detecting means for detecting presence/absence of a deviation in coupling of the elements is provided at the detecting position. The detecting portion has an element position detection member movable between a normal first contact position where the detection member does not contact any elements and an abnormal second contact position where it contacts an element. When the detection member exists at the first contact position when the chain is stopped, it is determined that the coupling is normal and when the detection member exists at the second contact position, it is determined that the coupling is abnormal.

7 Claims, 6 Drawing Sheets

COUPLING CONDITION DETECTING DEVICE FOR SLIDE FASTENER ELEMENT ROWS

BACKGROUND OF THE INVENTION

1. Field of the Invention

This invention relates to a coupling condition detecting device for slide fastener element rows (hereinafter, referred to as element rows), and more specifically, to an element coupling condition detecting device which is capable of detecting whether or not a coupling condition of the element rows of a pair of right and left fastener stringers, which are coupled with each other with a slider inserted therethrough, is acceptable when a continuous slide fastener chain (hereinafter referred to as fastener chain) is carried to various kinds of finish processing portions.

2. Description of the Related Art

Conventionally, a slide fastener finishing apparatus for obtaining a completed slide fastener product to be mounted on trousers, clothes, bag and the like by attaching a slider and stopper onto a fastener chain has been often employed.

Generally, when a completed slide fastener is obtained by attaching a single slider and stopper to the fastener chain, for example, a pair of upper stopper portions are formed separately at an end portion of the fastener chain at first. With the right and left element rows of the fastener chain separate and open, the other separated end portions of the fastener chain are inserted into the slider from its shoulder openings. After the insertion, the respective element rows are sent from an rear opening of the slider with the elements coupled and then a bottom stopper portion for binding the element end portions is provided on the fastener chain. The above-described operation is for attaching the slider and stoppers to the fastener chain which is carried by a gripper device constituted of a pair of right and left components and whose front end is gripped by the gripper device.

As another example of the conventional slide fastener finishing apparatus, Japanese Patent Application Laid-Open No. 2002-306212 previously proposed by the present applicant has disclosed a slide fastener finishing apparatus in which a fastener chain is carried from a slider passing portion disposed on a fastener chain carrying path to an element coupling portion disposed in the downstream of the chain of the slider passing portion. In the slide fastener finishing apparatus disclosed in the publication, a slider is loaded and fixed on the slider passing portion such that the rear opening of the slider is directed to a fastener chain introduction side and thereafter the fastener chain is brought into the rear opening of the slider with right and left element rows of the fastener chain coupled with each other. Then, the element rows, which are separated to the right and left and opened after carried from the shoulder opening of the slider, are inserted into the element coupling portion so as to couple the respective element rows with each other again.

After sent from the element coupling portion, the fastener chain whose element rows are coupled with each other is carried to a stopper portion forming portion for a single stopper, disposed in the downstream of the chain of the element coupling portion. A wire material for the stopper supplied to this stopper forming portion is cut out into a stopper piece of a predetermined length and the stopper piece is bent into a substantially inverted U shape so as to create a single stopper. Then, the stopper is attached to a pair of right and left fastener tapes such that it strides over the element rows of the fastener chain by bending into a substantially lateral C shaped configuration.

It is possible to obtain a slide fastener in which two sliders are contained such that their shoulder openings face each other by using the slide fastener finishing apparatus disclosed in the aforementioned publication. This slide fastener is used at an opening of, for example, a bag, a stationary case and the like and can be opened from its intermediate portion.

To produce such a slide fastener which can be opened from the intermediate portion as seen in the opening of the bag, stationary case and the like, two sliders are loaded on the fastener chain in a condition that their shoulder openings face each other when the two sliders and corresponding stoppers are mounted to the fastener chain. To obtain such a completed slide fastener product, the fastener chain is supplied along the chain carrying path on the slide fastener finishing apparatus in a condition that the fastener chain is gripped by a pair of right and left gripping portions of the gripper device.

The supplied fastener chain is inserted into the rear opening of one slider fixed and supported on the chain carrying path and the fastener chain is sent backward from the shoulder openings of the slider with the right and left element rows open. Subsequently, the fastener chain whose right and left element rows are open is supplied along the carrying path and then inserted into the shoulder openings of the other slider fixed and supported on the carrying path. After the insertion, the fastener chain whose right and left element rows are coupled is sent in a chain carrying direction from the rear opening of the slider. Then, the stopper is formed on the element end portion of the fastener chain whose right and left element rows are coupled.

Usually, when the fastener chain is inserted into the slider, front and back surfaces of the respective fastener tapes of the right and left fastener stringers need to be gripped by the pair of right and left gripper devices and carried horizontally. If the fastener tape is composed of elastic material or thin and soft, a torsion or deflection generated in the slide fastener during its transportation is likely to be applied to the fastener tapes in a separate condition unequally through each gripper device. If the right and left element rows are intended to be inserted into the slider with this condition, a difference in elongation/contraction or a slight difference in length occurs in each fastener tape itself such that a positional deviation occurs in coupling of elements on the right and left element rows or a coupling failure occurs. Thus, it is important to detect whether or not the coupling condition of the elements on the right and left element rows is acceptable when the fastener chain is supplied along the chain carrying path on the slide fastener finishing apparatus.

Generally, in the above-described slide fastener finishing apparatus, a number of finish processing portions are provided in series from the supply side of a continuous fastener chain to its outlet side. When a long continuous fastener chain is carried horizontally along the respective finish processing portions, various kinds of finish processing such as insertion into a slider, mounting of the stopper are carried out. However, because each element in the element rows is a small piece of about a few mm, it is extremely difficult to always check the coupling condition of the element rows accurately with the naked eye during such continuous work for the above-described fastener chain finish processing and further the visual check on a completed product cannot be started until all the processing works are completed. Therefore, in case where the fastener chain is supplied along the chain carrying path on the slide fastener finishing apparatus, there is no other method but checking the coupling condition of the elements of each completed slide fastener product visually after a slider and stopper are mounted on the fastener chain.

However, checking visually the element coupling conditions of the element rows constituted of small pieces of about a few mm in all completed slide fastener products not only takes a great amount of time, but may also affect the health of an operator. Further, that checking work needs a great amount of manppower and labor. Since the checking work is extremely simple and boring, it cannot be continued for a long time and working efficiency is dropped and additionally, there is a limit in mass production with a high accuracy. In views of the above-described circumstances, there has been a great demand for a checking system capable of detecting a positional deviation in the coupling of the elements in the right and left element rows and coupling failure early and efficiently without depending on human labor, thereby leading to improvement of productivity.

The invention has been achieved to solve the above-described conventional problems and a specific object of the invention is to provide a coupling condition detecting device for slide fastener element rows which is capable of detecting a deviation in coupling of a pair of right and left element rows which are coupled with each other with a slider mounted while carrying a continuous slide fastener chain through various kinds of finish processing portions, effectively and securely, thereby reducing finish processing cost and improving product yield.

SUMMARY OF THE INVENTION

According to an aspect of the invention, there is provided an element coupling condition detecting device for slide fastener element rows which is disposed at a carrying path of a fastener chain for detecting a coupling condition of right and left elements located adjacent an end of a space in the fastener chain, comprising: a chain stopping means for stopping transportation of the fastener chain at a detecting position of the right and left elements; and a detecting portion having a mechanical detecting means for detecting presence/absence of a deviation in coupling of the right and left elements when the fastener chain is stopped.

According to the invention, a pair of element rows of the fastener chain in a closed state sent from slider inserting portions disposed on the chain carrying path in the slide fastener finishing apparatus are transported toward the detecting portion disposed in the downstream of the chain adjacent the slider inserting portion. The detecting portion stops the transportation of the fastener chain and mechanically detects presence/absence of a deviation in coupling between the right and left elements.

Due to provision of the above-described configuration, the detecting position in the detecting portion and a timing for stopping the transportation of the fastener chain at the detecting position are set up preliminarily and when the element rows are carried to the detecting position, the chain stopping means is actuated to automatically stop the transportation of the fastener chain. The operation of the chain stopping means is carried out based on an instruction signal from a control portion according to a working procedure set preliminarily in the control portion. The detecting position may be set up arbitrarily depending on the length of the slide fastener which is a final product. The fastener chain can be sent to the detecting position intermittently through the chain stopping means. On the other hand, the mechanical detecting means of the detecting portion is driven and controlled independently from its waiting position to the detecting position to automatically detect a deviation in coupling of the respective element rows in a closed state.

It can be possible that when the fastener chain is stopped, the deviation in coupling between the right and left elements at the right and left coupling ends of the fastener chain is detected directly by image processing or electrically. However, largely different from those detecting devices, the invention adopts a method for directly mechanically detecting the deviation in coupling of the right and left elements with movement of the mechanical detecting means. Thus, it is possible to exclude an expensive and large detecting mechanism such as an image pickup tube, an image processing device, a proximity switch and a monitor which have been used conventionally.

Because the coupling condition of the right and left elements of a fastener chain carried along the chain carrying path is detected directly through the mechanical detecting means, a detecting object is specified securely and an influence of external disturbance is minimized, thereby providing an extremely highly reliable detection result.

According to the invention, detecting of the coupling condition of the element rows is carried out intermittently during a transportation of a continuous slide fastener chain through various kinds of finish processing portions. Therefore, a troublesome work for detecting a defect in the counpling elements of the element rows with the naked eye is eliminated and thus, the fastener chain can be carried efficiently from, for example, a fastener chain coupling step to a next stopper mounting step, thereby increasing work efficiency and productivity largely, decreasing production cost and further reducing load on a worker. Additionally, it is possible to avoid delay in production time, and also largely reduce working cost and equipment cost.

Preferably, the detecting portion comprises: an element position detection member which moves, when the fastener chain is stopped, between a preliminarily set first contact position of at least one element of the right and left elements and a second contact position deviated from the first contact position; and a determining portion which determines that it is normal when the element position detection member exists at the first contact position and determines that it is abnormal when the element position detection member exists at the second contact position.

The normal first contact position where the detecting portion is not in contact with at least one of the right and left elements when the fastener chain is stopped is set preliminarily and the moving range of the element position detection member to the fastener chain in which the coupling condition of the element rows is in the normal condition is preliminarily determined. Thus, the detecting portion moves only by the determined moving range and this moving range does not change. On the other hand, if any defect occurs in the coupling condition of the elements on the element rows, a deviation in coupling occurs in part of the coupled elements on the element rows. The element position detection member deviates from the first contact position and stops at the abnormal second contact position in which the element position detection member makes a contact with part of the elements. Thus, the moving range of the element position detection member largely changes.

The preliminarily-set first contact position when the element position detection member is in the normal condition and the second contact position when it is in the abnormal condition are detected and a detection signal is output to the control portion. The determining portion disposed in the control portion determines presence/absence of any abnormality obstructing normal production of the fastener chain based on the detection signal. If there is any abnormality or defect in part of the element rows, a mark is given to the fastener chain by a well known marking device before it is sent to a next step. The defective fastener chain may be discharged out of the process through, for example, a chain discharge conveyor, instead of the marking device. In this case, the defective fastener chain may be discharged out of the process by spouting pressurized air from an air blower to the defective fastener chain loaded on the chain discharge conveyor. Alternatively, the defective fastener chain may be discharged out of the process by operating a discharge bar by means of a cylinder.

The above-described configuration employs a simple structure which mechanically detects presence/absence of the elements which is coupled in the element rows. When the fastener chain is stopped, it is mechanically detected by moving the element position detection member whether at least one element of the right and left elements exists at the first contact position or the second contact. With this configuration, the structure of the detecting portion is simplified and practically available. Further, a cheap detecting portion can be obtained and a remarkable economic effect can be obtained without boosting the production cost. Further, because the structure of the detecting portion is simple, its maintenance is easy.

Preferably, the element position detection member is constituted of a first detection member and a second detection member provided with a gap between them so that the detection members contact the right and left elements respectively while the first detection member is disposed in an upstream of the chain with respect to the second detection member such that they are deviated by a pitch of a single element.

A simple structure which mechanically detects whether or not both right and left elements of the right and left element rows coupled with each other exist is adopted. According to the above-described structure, when the fastener chain is stopped, the first and second detection members are moved from the waiting position under the chain carrying path to the contact positions of the right and left elements stopped at the detecting position altogether. As a result, whether or not both of the elements exist can be detected mechanically at the same time by moving the both detection members. Therefore, by detecting whether or not the right and left elements exist based on the predetermined relation of the stop positions of the right and left elements by moving the first and second detection members together, whether or not the right and left elements are coupled with each other normally is determined, and a fast and accurate detection is enabled. Further, because the deviation in coupling of the right and left elements is detected directly and mechanically based on the mechanical motions of the first and second detection members, the structure of the detecting portion is never complicated or enlarged, thereby correspondingly reducing equipment cost largely.

Further, the element position detection member is preferred to have first and second moving means capable of advancing/retracting with respect to the first contact position.

For a fastener chain in which the coupling condition of the element rows is in the normal condition, the element position detection member advances to the first contact position through the moving means. If a deviation in coupling of part of the elements on the element rows occurs, the moving of the element position detection member to the first contact position is obstructed during the moving and then the element position detection member stops at the second contact position which is deviated from the first contact position. According to the above-described configuration, whether any element, which is coupled, of the element rows exists is detected by a detector which is activated corresponding to the advancement/retraction of the element position detection member and whether the element of the element rows exists is determined by the determining portion disposed in the control portion according to the detection signal dispatched from the detector.

Due to the adoption of the above-described configuration, the element position detection member can be moved securely and stably although the moving means to be employed has a simple structure. Further, since the detection is carried out by the detector after the fastener chain is stopped in an unmoved state by the stopping means, the fastener chain is not moved easily and thus whether or not the element, which is coupled, of the element rows exists can be detected accurately and smoothly.

Further, the element position detection member is preferred to include a photoelectric detector for detecting an advancement/retraction position of the element position detection member when the element position detection member advances/retracts.

The presence or absence of the coupling element of the element rows is detected by the photoelectric detector which is activated corresponding to the advancement/retraction position of the element position detection member. The presence or absence of the element, which is coupled, of the element row is determined by the determining portion disposed in the control portion based on the detection signal from the detector. According to the above-described configuration, the detection is executed by the single photoelectric detector and thus the structure of the detecting portion is simplified. Further, by monitoring the moving condition of the element position detection member between the first contact position and the second contact position, whether or not the element exists can be determined promptly and a stabilized detection accuracy can be always maintained.

Further preferably, the element position detection member is configurated so as to wait at the first contact position before the fastener chain is stopped and be movable between the first and second contact positions.

If the element row coupled end face collides with the element position detection member during monitoring the fastener chain being transported, the element position detection member moves from the first contact position to the second contact position. As a result, the moving of the element position detection member increases momentarily such that the element position detection member goes beyond a predetermined acceptable moving range. Consequently, the abnormal moving is detected so as to determine whether or not any deviation in coupling of the elements occurs.

As mentioned above, transporting the fastener chain made possible to determine whether or not a deviation in coupling of the elements occurs, based on the moving range of the element position detection member from the first contact position to the second contact position after collision of the end face of the element row with the element position detection member. As a result, the element position detection member advances or retracts over a predetermined distance smoothly matching a timing without the necessity of any special driving source. Because the element position detection member moves linearly along the chain carrying path, the posture of the element position detection member does not change during the detection and then the element position detection member can contact the element end face with a right posture thereby obtaining effectively a stabilized detection accuracy to a defect in the element row.

The element coupling condition detecting device is preferred to further comprise a proximity switch for detecting a moving position of the element position detection member when the element position detection member moves between the first and second contact positions.

Because the proximity switch is employed as the detector for detecting the moving position of the element position detection member, the distance between the first contact position and the second contact position can be set up freely along the fastener chain carrying path. Changing this distance enables not only the element position detection member to move securely and stably but also the right and left elements at the element end of the fastener chain transported along the chain carrying path to be detected accurately and smoothly.

DESCRIPTION OF THE PREFERRED EMBODIMENTS

Hereinafter, preferred embodiments of the invention will be described in detail with reference to the accompanying drawings.

Figure 1:
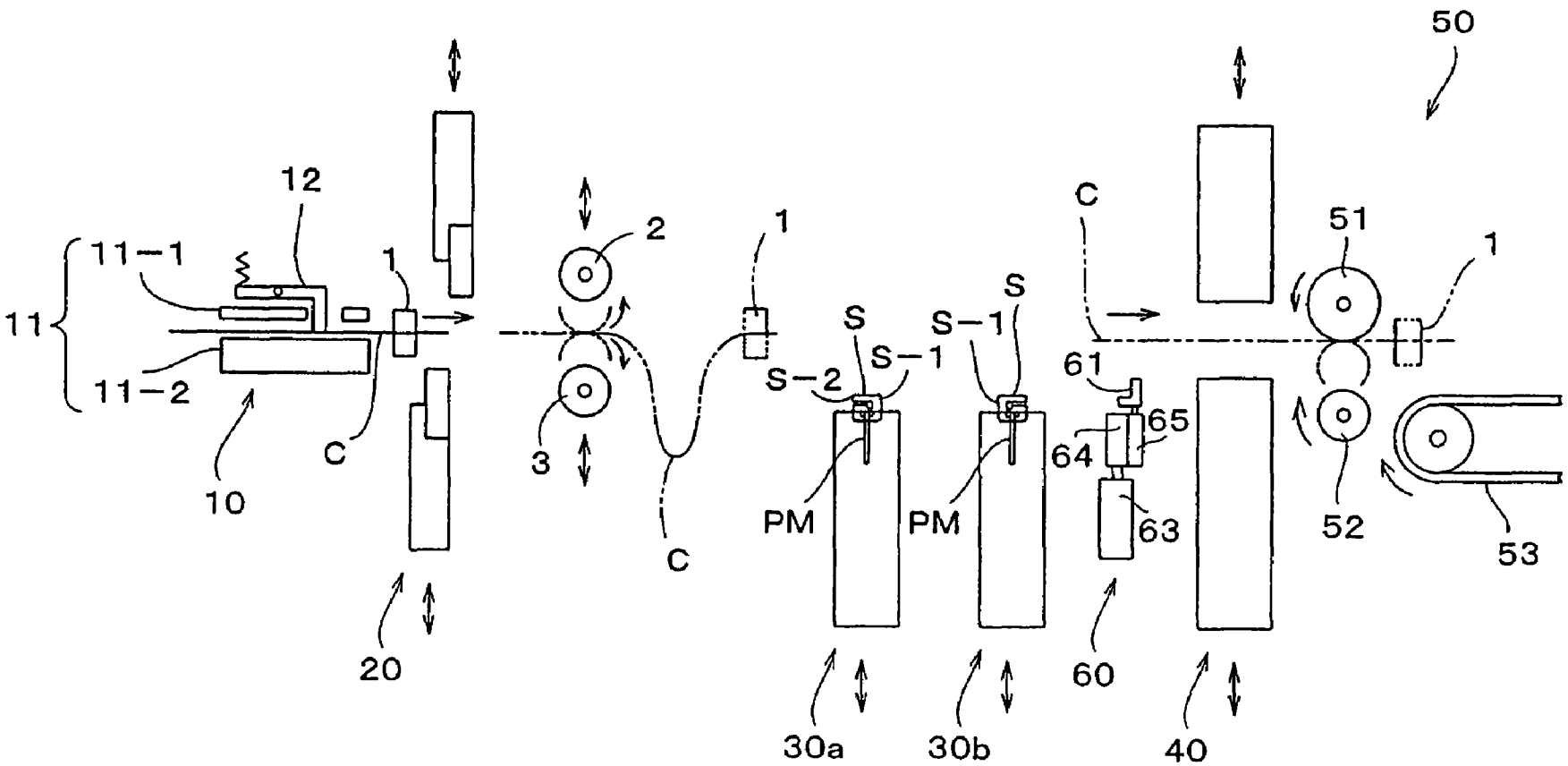
FIG. 1 is an explanatory diagram showing the schematic configuration of a slide fastener finishing apparatus provided with a coupling condition detecting device for slide fastener element rows of the invention.
Figure 2:
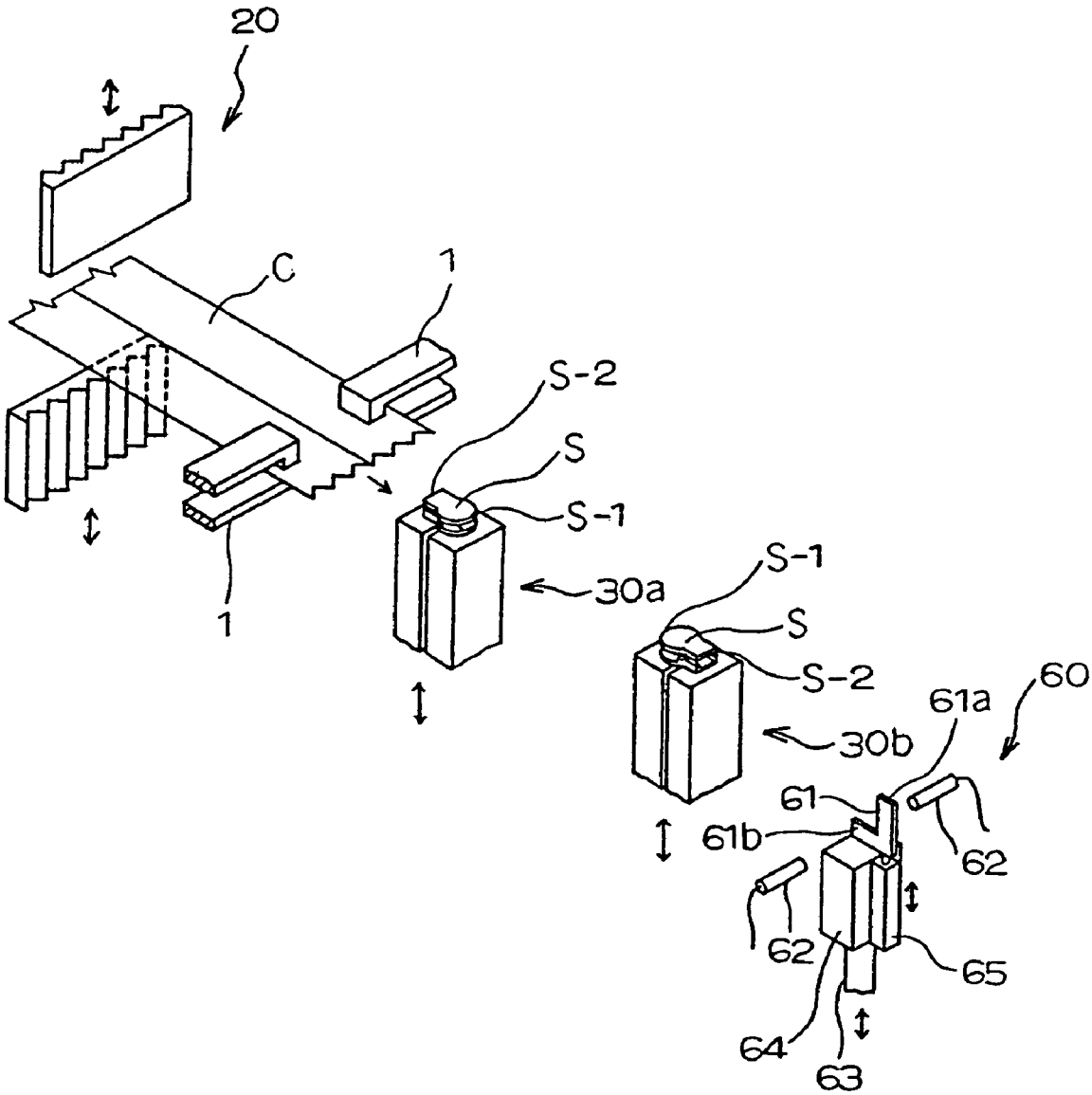
FIG. 2 is a perspective view showing major components of a typical embodiment of the finishing apparatus.

Referring to FIGS. 1 and 2, a finishing apparatus for a fastener chain of this embodiment comprises various kinds of finish processing portions such as a chain positioning portion 10, a cutter portion 20, first and second slider inserting portions 30*a*, 30*b*, a stopper attaching portion 40 and a chain discharging portion 50, these components being disposed in series along a carrying path arranged in the longitudinal direction of a long continuous fastener chain C. A detecting portion 60, which forms a prominent feature portion of the invention for detecting the coupling condition between first and second element rows ER1, ER2 on the right and left sides of a slide fastener, is disposed serially in the adjacent downstream of the second slider inserting portion 30*b*. All various kinds of operating members in the finish processing portions 10 to 50 and detecting portion 60 are controlled according to a control procedure set preliminarily on a control portion (not shown).

Using the slide fastener finishing apparatus shown in the figures, for example, a slide fastener to which two sliders S are attached with their shoulder openings S-1 facing each other is obtained. This slide fastener is used for, for example, an opening of a bag, a stationary case and the like and the slide fastener can be opened from its intermediate portion. When finishing the slide fastener, two sliders S are placed and fixed on the first and second slider inserting portions 30*a*, 30*b* disposed successively in series along the chain carrying path such that their shoulder openings S-1 face each other with their pulls PM drooping and thereafter the fastener chain C is supplied along the chain carrying path on the slide fastener finishing apparatus with their front ends in the longitudinal direction being gripped horizontally by a pair of right and left feeding grippers 1, 1.

Although the driving of these feeding grippers 1, 1 is not restricted to any particular type, they are controlled and driven corresponding to a sequence of the entire finishing apparatus based on data stored preliminarily in a control portion (not shown). The feeding grippers 1, 1 are disposed on an X-Y axis carrying base (mobile base) (not shown), which are driven by servo motors (not shown) for X-axis driving and Y-axis driving, the servo motors being driven and controlled for the X-Y directions based on an instruction from the control portion. Consequently, the grippers 1, 1 grip the right and left front ends of the fastener chain C and carry the chain along the chain carrying path (X-axis) while opening or closing the right and left front ends in the Y-axis direction perpendicular to the X-axis direction. As this gripper, it is possible to use a gripper unit having the same configuration in its main portion as the gripper unit disclosed in the aforementioned Japanese Patent Application Laid-Open No.2002-306212 proposed by the applicant.

Figure 3:
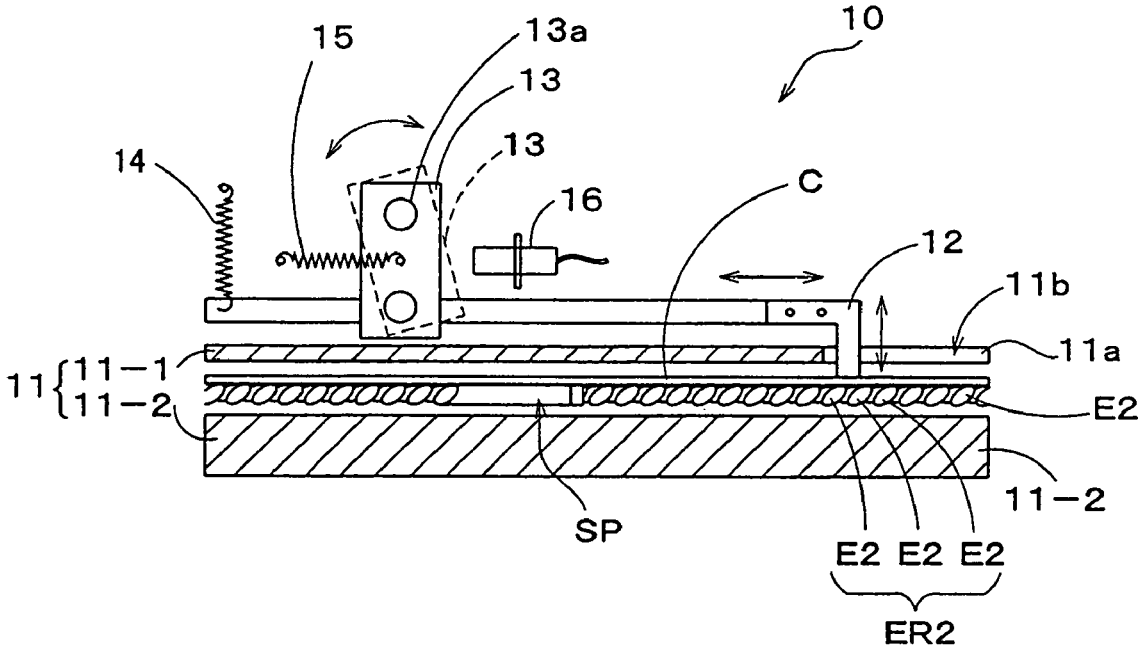
FIG. 3 is an enlarged major component sectional view showing schematically an example of the structure of a chain positioning portion applied to the finishing apparatus.

FIG. 3 shows schematically an example of the structure of the chain positioning portion 10. The chain positioning portion 10 is disposed in the upstream of the cutter portion 20 in the fastener chain finishing apparatus. The chain positioning portion 10 comprises upper and lower chain guide portions 11 for guiding the fastener chain C being carried with the element rows ER (ER1, ER2) coupling with each other and a chain stopper 12 for stopping the transportation of the fastener chain C supplied, as shown in FIG. 3. The fastener chain C carried to this chain guide portion 11 intermittently has a space portion SP of a predetermined length having no elements E (E1, E2) between element rows ER of a predetermined length. A lower stopper (not shown) is already mounted on an end portion in the upstream of this space portion SP.

The chain guide portions 11 are fixed on a fixed frame (not shown) and a stopper guide plane 11*a* having a stopper passage space portion 11*b* in which the front end of the chain stopper 12 is inserted is formed at part of the upper chain guide 11-1 in the downstream of the chain. The chain stopper 12 is formed of a narrow plate member of a substantially inverted L-shape having such a thickness which allows itself to invade into the space portion SP in the fastener chain C through the aforementioned stopper passage space portion 11*b*. This chain stopper 12 is fixed on and supported by a bottom end of a support member 13 which rotates within a perpendicular plane around a support shaft 13*a* disposed at its upper end portion, so that the upper chain guide 11-1 is capable of rotating in the same direction. The end portion of the chain stopper 12 on the downstream side is always urged toward the fastener chain C by a first compression spring 14 stretched between a fixed frame (not shown) and the upper chain guide so that a pawl at the front end of the chain stopper 12 elastically invades into the space portion SP in the fastener chain C being carried to the chain guide portion 11. Then, the chain stopper 12 is supported so as to be capable of advancing/retracting with respect to a chain carrying direction through a second compression spring 15 stretched from the support member 13. A proximity switch 16 which dispatches a chain stop signal when the chain stopper is inserted into the space portion SP is provided in the downstream near the support member 13.

Now, the first and second Y-axis drive servo motors are actuated according to an instruction signal from the control portion following a preliminarily set sequence to move the right and left feeding grippers 1, 1 located at the waiting positions toward the right and left front ends of the fastener chain C. When the right and left feeding grippers 1, 1 reach the gripping positions at the right and left front ends, the first and second Y-axis drive servo motors are stopped to grip the right and left front ends of the fastener chain C. The gripping positions of the right and left feeding grippers 1, 1 are set at positions apart at a predetermined distance from an end face of the chain stopper 12 which makes contact with the element row ER. If this gripping is finished, an instruction signal is generated from the control portion so that the first and second X-axis drive servo motors are started and the right and left feeding grippers 1, 1 is moved in the X-axis direction up to the chain guide portion 11.

If the fastener chain C is carried in a sliding condition by guiding the element rows ER with the feeding grippers 1, 1 throughout the chain guide portion 11, the chain stopper 12 swings downward toward the fastener chain C around the support shaft 13*a* due to elasticity of the first compression spring 14. Consequently, the pawl at the front end of the chain stopper 12 invades into the space portion SP through the stopper passage space portion 11*b* in the chain guide portion 11. The fastener chain C continues to move in this while also.

The first and second slider inserting portions 30*a*, 30*b* are disposed in series in the downstream of the chain positioning portion 10. The fastener chain C carried by the right and left feeding grippers 1, 1 from the chain positioning portion 10 is sent to the first and second slider inserting portions 30*a*, 30*b*. The respective slider inserting portions 30*a*, 30*b* supports a lower blade of the slider S in a condition that a rear opening S-2 of the slider S is directed to the upstream side of the chain located on the chain carrying path.

Figure 4:
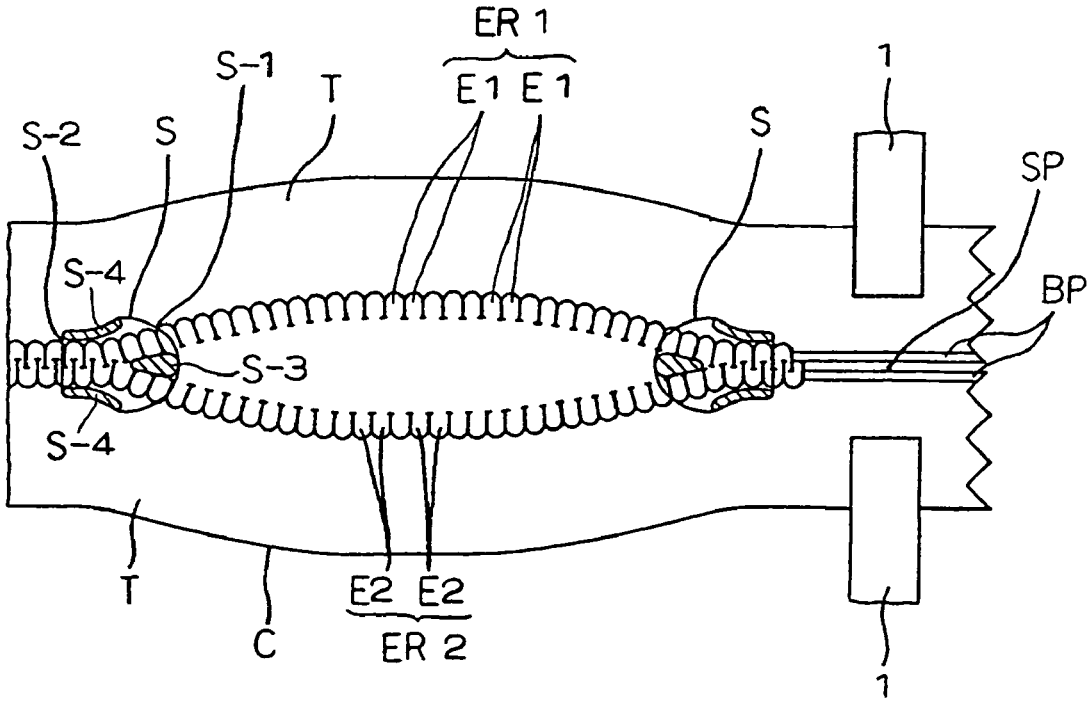
FIG. 4 is a plan view showing part of a slide fastener chain after a slider is mounted.

FIG. 4 shows the fastener chain C after inserted into the slider. The fastener chain C is introduced into the rear opening S-2 of the slider S and let it pass a connecting post S-3 and then the front ends of the fastener chain C are sent from the shoulder openings S-1 of the slider S in the chain carrying direction with the respective element rows ER1, ER2 separated to the right and left sides such that they are opened. The fastener chain C supplied in the condition that the right and left element rows ER1, ER2 of the fastener chain C are coupled with each other is inserted into the first slider inserting portion 30*a* from the rear opening S-2 of one slider S loaded and fixed preliminarily and after passing the slider S, the fastener chain C is sent rearward from the shoulder openings S-1 of the slider S with the right and left element rows ER1, ER2 separated such that they are opened. At this time, the first and second Y-axis drive servo motors start to rotate inversely so as to move the right and left feeding grippers 1, 1 in a direction in which they separate from each other along the Y-axis. During this moving in the Y-axis direction, the first and second X-axis drive servo motors continue to rotate so that the right and left feeding grippers 1, 1 move in the X-axis direction at the same time when they move in the Y-axis direction.

The fastener chain C with the right and left element rows ER1, ER2 opened continues to be transported along the carrying path and the element rows ER1, ER2 separated and opened to the right and left sides are inserted into the shoulder openings S-1 of the other slider S placed and fixed on the second slider inserting portion 30*b* so as to couple the respective element rows ER with each other. At this time, the first and second Y-axis drive servo motors are rotated in a normal direction while the first and second X-axis drive servo motors are kept to rotate, to approach the right and left feeding grippers 1, 1 in the Y-axis direction, thereby closing the element rows ER1, ER2 separated to the right and left sides. On the other hand, the right and left feeding grippers 1, 1 are moved in the X-axis direction by continuing the rotation of the first and second X-axis drive servo motors. After the insertion, the fastener chain C in the condition that the right and left element rows ER are coupled with each other is sent to the stopper attaching portion 40 at a next step from the rear opening S-2 of the slider S.

The element rows ER after being sent from the second slider inserting portion 30*b* passes the detecting portion 60, which is the feature portion of the invention described later, and thereafter, the fastener chain C in the condition that the element rows are coupled is sent to the stopper attaching portion 40 disposed in the downstream of the chain for attaching single stopper. In the fastener chain C carried from the second slider inserting portion 30*b* by the feeding gripper 1, the chain stopper 12 of the chain guide portion 11 disposed at the chain positioning portion 10 abuts elastically against the end face of an element positioned at an upstream end of the space portion SP in the fastener chain C.

At this time, the chain stopper 12 is pressed by the end face of the element positioned at the upstream end of the space portion SP and the support member 13 swings toward the downstream of the chain such that it moves at a predetermined distance in the downstream of the chain in defiance of the second compression spring 15 as shown by dotted line in FIG. 3. If it is detected that the front end portion in the longitudinal direction of the fastener chain C reaches a stopper mounting position located downstream, an operation instruction is dispatched form the control portion by receiving a signal from the proximity switch 16. Consequently, a timer device or distance measuring device (not shown) is actuated and after the fastener chain C moves in a specified interval of time or at a specified distance, the rotation of the first and second X-axis drive servo motors is stopped.

To attach the upper stopper, the first and second Y-axis drive servo motors start rotation in the inverse direction to move the right and left feeding grippers 1, 1 in a direction that they separate from each other along the Y-axis. At this stop time, the upstream end portion of the space portion SP corresponds to an installation position of the upper stopper attaching portion 40 and a substantially intermediate portion corresponding to the front end of the next space portion SP of the fastener chain C corresponds to a cutting position of the cutter portion 20.

At this stopper attaching portion 40, a stopper wire (not shown) to be supplied is cut out into a stopper piece of a predetermined length and the stopper piece is bent into a substantially inverted U shaped configuration to form a single stopper. Then, the stopper is bent into a substantially lateral C-shaped configuration to stride over element rows ER in a coupling condition of the fastener chain C and attached at a specific position of the fastener tape T in the fastener chain C in which the right and left element rows ER1, ER2 are coupled with each other. Consequently, the stopper portion is formed to connect the right/left first and second element end portions, which are located adjacent the space upstream end in the fastener chain C.

If the mounting of the single stopper by the stopper attaching portion 40 is finished, the cutter portion 20 is actuated to cut out the fastener chain C. If a rear end of the fastener chain C is sent to the cutter portion 20, the transportation of the fastener chain C is stopped by the chain stopper 12 in the chain guide portion 11 disposed at the chain positioning portion 10 as described above. At this stop time, the cutter portion 20 cuts out the substantially intermediate portion of the space portion SP which is a rear end of the long continuous fastener chain after it arrives at the cutter portion 20 so as to obtain a fastener chain of a predetermined length. Then, the first and second X-axis drive servo motors are driven to move the right and left feeding grippers 1, 1 so that the front end of the fastener chain C is carried to the chain discharge portion 50 which is a next step.

At the chain discharge side of the fastener chain C finishing apparatus, the chain discharge portion 50 is provided in the downstream of the stopper attaching portion 40. In the chain discharge portion 50, as shown in FIG. 1, a pair of rollers 50, 51 are disposed on upper and lower positions across the fastener chain C. The indicated example includes a drive roller 51 which is supported above the chain carrying path by a support member (not shown) such that it is capable of rotating freely and a pressure roller 52 which is disposed at a waiting position below the chain carrying path located at a corresponding position to the drive roller 51 and raised to the drive roller 51 when the front end in the longitudinal direction of the fastener chain C carried by the feeding gripper 1 passes the rollers. The pressure roller 52 is supported, for example, at a rod end of a fluid pressure cylinder (not shown) such that it is capable of rotating freely.

After the fastener chain C is cut out as described above, the pressure roller 52 is raised at a predetermined timing and the fastener chain C of a required length is gripped between the pressure roller 52 and the drive roller 51. At this time, the gripping of the feeding grippers 1, 1 is released to return the feeding grippers 1, 1 to initial waiting positions on a chain supply side of the fastener chain finishing apparatus. At the same time, the drive roller 51 is started to send the short fastener chain on which all processing are completed to a discharge conveyor 53 such that the fastener chain is discharged out of the process by the discharge conveyor 53. Consequently, a completed slide fastener product is obtained. Next, the above-described operation is repeated successively to finish a next fastener chain of the required length.

There is a case where the unit length of the slide fastener is changed using the same fastener chain C. The position where the right and left feeding grippers 1, 1 after returning to the initial waiting positions on the chain supply side grip the right and left front ends of a next fastener chain C is set to a position apart by a predetermined distance in the chain carrying direction on the downstream side from the end face of the chain stopper 12 which makes contact with the element rows ER. Now, after the first and second X-axis drive servo motors are started, the feeding grippers 1, 1 which grip the right and left front ends of the next fastener chain C move from the aforementioned gripping position to a predetermined position before the first slider inserting portion 30*a*. In the meantime, presence/absence of a next space portion SP in the fastener chain C is continuously monitored through the chain stopper 12 by a control portion (not shown).

If the unit length of the slide fastener is changed and the distance between the spaces is longer than the initially set length, no space portion SP in the fastener chain C is detected by the chain positioning portion 10 while the right and left feeding grippers 1, 1 leave the gripping position in the downstream of the chain positioning portion 10 and reach the predetermined position before the first slider inserting portion 30*a*. In this case, the right and left feeding grippers 1, 1 are instructed to stop at the predetermined position set before the first slider inserting portion 30*a* after they leave the gripping position in the downstream of the chain positioning portion 10. After the right and left feeding grippers 1, 1 stop at this predetermined stop position, the feeding rolls 2, 3 disposed at upper and lower positions across the fastener chain C adjacent the downstream side in the chain carrying direction of the cutter portion 20 begin to move in a direction that they approach to sandwich the top and bottom surfaces of the fastener chain C at a predetermined timing as shown in FIG. 1. The feeding roll 2 disposed at a waiting position above the chain carrying path is configurated as a drive roll which is supported at a rod end of a fluid pressure cylinder (not shown) such that it is capable of rotating freely. The feeding roll 3 which is disposed at a corresponding position to the drive roll and at a waiting position below the chain carrying path is configurated as a driven roll which is supported at a rod end of a fluid pressure cylinder (not shown) such that it is capable of rotating freely like the feeding roll 2.

If, after the fastener chain C is gripped between the feeding rolls 2 and 3, the feeding roll 2 begins to drive, the fastener chain C is sent out to the downstream side in the chain carrying direction with the fastener chain C drooping as shown by two-dot and dash line in FIG. 1. The fastener chain C is fed by a length corresponding to a distance from the aforementioned predetermined position up to the detecting portion 60 through the second slider inserting portion 30*b* with respect to the gripping position of the feeding grippers 1, 1. In the meantime, the space portion SP in the fastener chain C is continuously monitored by the control portion.

If the space portion SP is detected in the fastener chain C, an operation instruction is dispatched from the control portion after receiving a signal from the proximity switch 16 of the chain positioning portion 10 so as to stop the rotation of the feeding rolls 2, 3. At this stop time, the substantially intermediate portion in the space portion SP which is a rear end of the fastener chain C is cut out by the cutter portion 20. Subsequent to this cutting, the gripping of the feeding rolls 2, 3 is released and the feeding rolls 2, 3 are returned to the initial waiting positions and at the same time the moving of the feeding grippers 1, 1 is restarted. By moving the feeding grippers 1, 1, the fastener chain C is carried to the first, second slider inserting portions 30*a*, 30*b*, the detecting portion 60, the stopper attaching portion 40, and the chain discharge portion 50 successively, as described previously, so as to finish a fastener chain of the required length.

When the unit length of the slide fastener is changed to an extremely long one as described, even if the fastener chain C is fed by the length corresponding to the distance from the aforementioned predetermined position up to the coupling condition detecting portion 60 to the downstream side in the chain carrying direction by the feeding rolls 2, 3, no space portion SP of the fastener chain C may be detected. In this case, the feeding grippers 1, 1, which stay at the predetermined position, are restarted while the operation of the feeding rolls 2, 3 is continued. The restarting of the feeding grippers 1, 1 is carried out by, for example, preliminarily setting pause time of the feeding grippers 1, 1 by a timer. That is, before the space portion SP in the fastener chain C is detected, the fastener chain C is carried to the first and second slide inserting portions 30*a*, 30*b* and the coupling condition detecting portion 60 by the feeding grippers 1, 1 to execute a predetermined processing and then moved up to the position where the grippers 1, 1 make final stop and the fastener chain is transferred to a next step. During this process, the feeding rolls 2, 3 keep feeding the fastener chain C to the downstream side in the chain carrying direction without stopping its rotation and the control portion continues to monitor the space portion SP in the fastener chain C.

If the space portion SP in the fastener chain C is detected, an operation instruction is dispatched from the control portion after receiving a signal from the proximity switch 16 of the chain positioning portion 10 so as to stop the rotation of the feeding rolls 2, 3. At this stop time, the substantially intermediate portion of the space portion SP in the fastener chain C is cut off by the cutter portion 20 and at the same time the gripping of the feeding rolls 2, 3 is released and the feeding rolls 2, 3 are returned to their initial positions. Like this, depending on the length of the fastener chain C, detecting whether or not a deviation in coupling between the right and left elements E1 and E2 of the fastener chain C or mounting of the stopper is completed before the space portion SP in the fastener chain C is detected.

On the other hand, if the unit length of the slide fastener to be set newly is shorter than the distance between the first gripping position of the grippers 1, 1 and the predetermined stop position before the slider inserting portion 30*a*, the space portion SP in the fastener chain C is detected before the right and left feeding grippers 1, 1 arrive at the predetermined position before the first slider inserting portion 30*a* in the chain positioning portion. In this case, if the space portion SP is detected, the substantially intermediate portion of the space portion SP in the fastener chain C is cut off by the cutter portion 20 and at the same time an operation instruction is dispatched from the control portion and the feeding grippers 1, 1 are kept moving without starting the operation of the feeding rolls 2, 3. The feeding grippers 1, 1 continues moving to carry the fastener chain C to the first and second slider inserting portions 30*a*, 30*b*, the detecting portion 60, the stopper attaching portion 40 and the chain discharge portion 50 successively for each required processing.

While the long continuous fastener chain is carried horizontally throughout all the finish processing portions disposed from the fastener chain supply side to the discharge side, a single fastener chain of a required length which is an object for a completed product undergoes finish processing. The configurations of these finish processing portions 10 to 50 have been well known except the detecting portion 60 and therefore description thereof in detail is omitted. The invention is not restricted to the above-described fastener chain finishing apparatus, but needless to say, the invention may be applied to any other well-known conventional apparatuses.

The prominent feature of the invention exists in the detecting portion 60 which detects presence/absence of a deviation in coupling between the right and left elements E1 and E2 in the first and second element end portions of the fastener chain C carried continuously.

Figure 6:
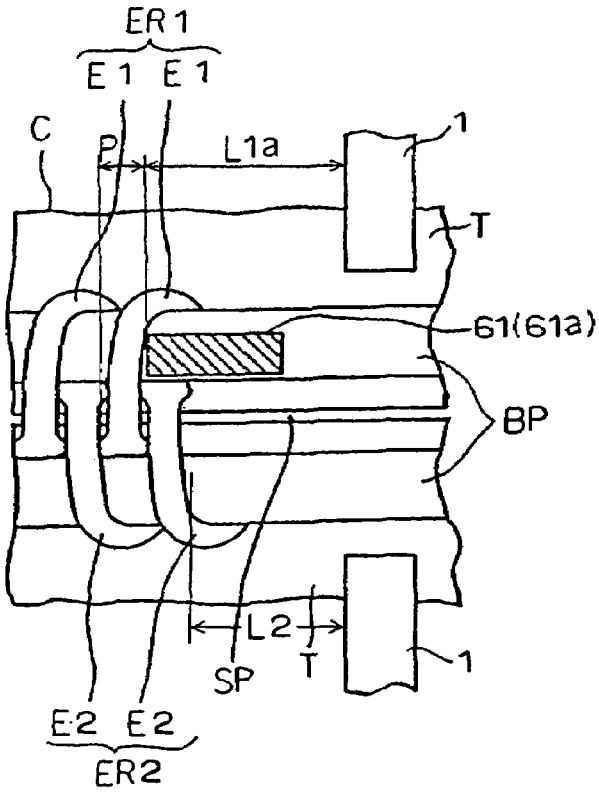
FIG. 6 is a partially enlarged plan view for explaining a condition in which the element position detection member applied to the detecting device is kept in contact with slide fastener element rows in a normal state.

According to this embodiment, when the fastener chain C is gripped by the respective feeding grippers 1, 1 with the element end portions of the first and second element rows ER1, ER2 in a normal coupling condition as shown in FIG. 6, a distance between one feeding gripper 1 and an end face of an element E1 of the first element row ER1 is set to L1*a* while a distance between the other feeding gripper 1 and an end face of an element E2 of the second element row ER2 is set to L2. At this time, the distance L2 is shorter than the distance L1*a* and the end face of the element E2 of the second element row ER2 is disposed closer than the end face of the element E1 of the element row ER1 relative to the feeding gripper 1 by a pitch P of a single element.

Figure 7:
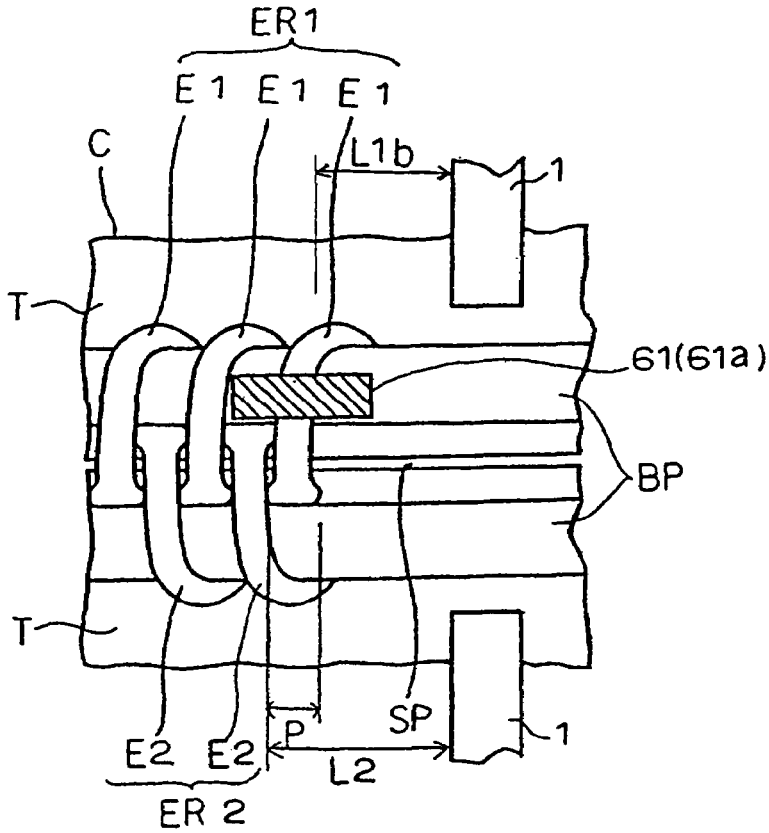
FIG. 7 is a partially enlarged plan view for explaining a condition in which the element position detection member is kept in contact with slide fastener element rows in an abnormal state.

Generally, when the element rows ER1, ER2, which are separated to the right and left sides such that they are opened, are inserted into the second slider inserting portion 30*b* to couple the respective element rows ER with each other again, an element end portion of a preceding element row ER2 is firstly inserted into the shoulder opening S-1 of the slider S. At this time, if the element end portion of the element row ER2 makes excessive contact with (presses) the connecting post S-3 or side flanges S-4, S-4 of the slider S as shown in FIG. 4 such that a high resistance applies to insertion of the d element end portion, the element end portion of the preceding element row ER2 can be caught inside the slider and thus smooth insertion may possibly be blocked instantaneously. If next, the element end portion of the element row ER1 is inserted subsequent to the element end portion of the element row ER2 smoothly without making an excessive contact with the connecting post S-3 and the side flanges S-4, S-4 of the slider S, the element end portion of the first element row ER1 has an abnormal deviation in coupling where the element is deviated in coupling by the pitch P of a single element as shown in FIG. 7.

That is, if the aforementioned defect occurs when the element end portion of the element row ER2 which is to be inserted into the slider S first is inserted, a deviation in coupling position occurs in the element row ER1 which is to be inserted through the slider S subsequently. Usually, the deviation in coupling position which occurs between the first element row ER 1 and the second element row ER2 mostly results from such defect and a deviation in coupling position in an inverse relation seldom occurs between the first element row ER1 and the second element row ER2. Therefore, according to this embodiment, the detecting portion 60, which mechanically detects presence/absence of a deviation in coupling of the element row ER1 inserted through the slider S subsequent to the element end portion of the element row ER2 inserted through the slider S first will be described as an example.

The detecting portion 60 according to the first embodiment of the invention is disposed adjacent the downstream side of the second slider inserting portion 30*b* as shown in FIG. 2. This detecting portion 60 comprises chain stopping means for stopping the transportation of the fastener chain C at a detecting position of each of the right and left elements E1, E2 and mechanical detecting means for detecting presence/absence of a deviation in coupling of at least any one of the right and left elements E1, E2 when the fastener chain C is stopped.

Although, as an example of the chain stopping means, the chain stopper 12 may be used as part of the chain stopping means, the invention allows space portion detecting means (not shown) to independently detect the space portion SP where an element E of the fastener chain C is missing in the upstream of the chain of the chain stopper 12 disposed at, for example, the chain positioning portion 10. As this space portion detecting means, it is permissible to provide a sensor (not shown) such as a micro switch and a proximity switch which can detect the space portion SP in the carried fastener chain C and dispatches a space portion detection signal. If the substantially intermediate portion of the space portion SP on which a slider is to be mounted next is detected by the aforementioned space portion detecting means during the transportation of the fastener chain C, an operation instruction is dispatched from a control portion (not shown) after receiving the signal and the X-Y axis drive servo motors for driving the right and left feeding grippers 1, 1 are stopped, thereby stopping the transportation of the fastener chain C. According to the invention, the servo motors for the feeding grippers 1, 1 may be controlled according to the sequence of the entire finishing apparatus memorized in the control portion.

Although the above-described configuration is not restricted to any particular one, the chain stopping means which forms part of the feature portion of the invention is included. According to the invention, the operation of the chain stopping means is carried out following an operation procedure set preliminarily on the control portion and based on an instruction signal from the control portion. The operation of the chain stopping means may be set arbitrarily depending on the length of the slide fastener which is a final product and may be sent intermittently to a detecting position of the detecting portion 60.

The mechanical detecting means comprises fluid pressure actuating means disposed below the chain carrying path, an element position detection member 61 which moves to the element end portion of the fastener chain C through the fluid pressure actuating means, and a detector 62 for detecting the moving range of the element position detection member 61.

The fluid pressure actuating means comprises a first cylinder which is a first moving means (hereinafter referred to as first cylinder 63) fixed on a support member (not shown) and a second cylinder which is a second moving means (hereinafter referred to as second cylinder 65)and is mounted on a side of a bracket 64 fixed on an rod end of the first cylinder 63 and capable of moving up/down in the same direction independently of the first cylinder 63. The first cylinder 63 is automatically stopped at a predetermined position by a limit switch (not shown) in order to avoid a collision with the slider S mounted on the fastener chain C carried to the detecting portion 60.

Figure 5:
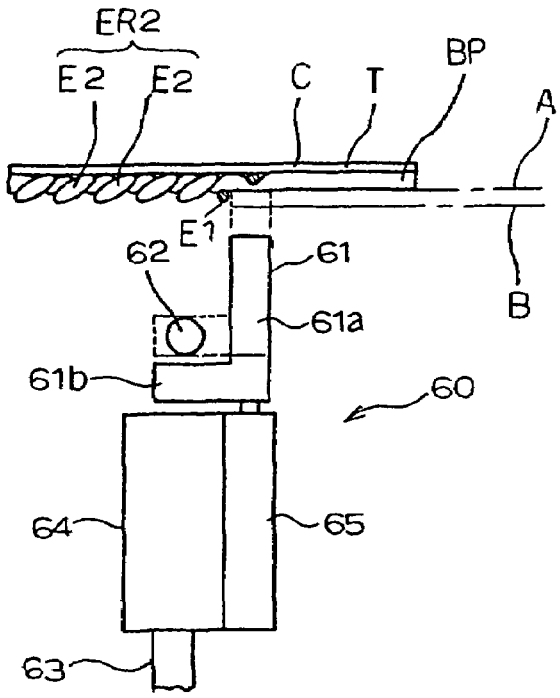
FIG. 5 is a partially enlarged side view for explaining the operating condition of a element position detection member applied to the above-described detecting device.

FIG. 5 shows an operating condition of the element position detection member 61 applied to the above-described detecting means unit. When this element position detection member 61 completes rising from a waiting position below the chain carrying path up to the detecting position, a sensor (not shown) detect the completion and stop the operation of the second cylinder 65. The first and second cylinders 63, 65 can be assembled on a common supporter and constructed into a unit thereby leading to compactness and reduction in size of the apparatus.

The element position detection member 61 is formed of a plate member, comprising a vertically erected portion 61*a* which is bent in a substantially L-shaped configuration and a horizontal portion 61*b*. An front end of this vertically erected portion 61*a* forms a contact face which makes a contact with the element end portion of the fastener chain C. On the other hand, the horizontal portion 61*b* is extended horizontally toward the upstream of the chain from a bottom end of the vertically erected portion 61*a*, and a bottom face of the horizontal portion 61*b* below the vertically erected portion 61*a* is supported by a rod end of the second cylinder 65. The vertically erected portion 61*a* moves up and down between the waiting position below the chain carrying path and the detecting position of the element end portion of the fastener chain C.

With this configuration, the element position detection member 61 is able to move securely and stably. Further, since the detection is executed by the moving of the element position detection member 61 after the fastener chain C is stopped by the chain stopping means, the fastener chain C keeps a fixed position and thus a deviation in coupling of the elements E on the element rowss ER can be mechanically detected at a high accuracy.

The aforementioned detecting position includes a first contact position A when the element end portion is in a preliminarily set normal condition and a second contact position B when it is in an abnormal condition as shown in FIGS. 5 and 6. A region between the first contact position A and the second contact position B is a detection region by the element position detection member 61. FIGS. 6 and 7 show each enlarged view of this condition. FIG. 6 shows a state that the element position detection member 61 is in contact with the first contact position A in which the element end portion is in the preliminarily set normal condition without being contact with the element E1, and FIG. 7 shows a state that the element position detection member 61 is in contact with the second contact position B in which the element end portion is in the abnormal condition with being contact with the element E1.

In FIGS. 6 and 7, symbols L1*a* and L2 designate a distance between each feeding gripper 1 and the element end portion of each of the paired element rows ER1, ER2 when the element coupling condition is normal. A symbol L1*b* in FIG. 7 designates a distance between the feeding gripper 1 and the element end portion of the element row ER1 when the element coupling condition is abnormal. As evident from these diagrams, when the element end portion is in the abnormal condition, the distance between the feeding gripper 1 and the element end portion of the element row ER1 is in the relation of L1*a*>L1*b* and thus a tape portion between the feeding gripper 1 and the element E1 of the element row ER1 is in a bad condition which is a wave-like distorted condition.

According to the first embodiment, a photo detector 62 is used as the detector 62 which detects moving range in the vertical direction of the element position detection member 61 at a fixed position when the rod end of the second cylinder 65 moves a predetermined distance. As for the photo detector 62, as shown in FIG. 5, its projector and receiver are disposed so as to oppose each other with a predetermined gap interporsing the element position detection member 61 and they are also disposed in the same direction such that their detecting faces oppose plate faces of the horizontal portion 61*b*. According to the indicated example, when the detecting faces of the projector and receiver oppose the plate faces of the horizontal portion 61*b*, an output is ON. Needless to say, the output may be ON when an inverse operation occurs.

A conventionally well-known structure capable of detection can be applied to the element position detection member 61. As another example of the detector, it is permissible to use various kinds of sensors such as ultrasonic sensor, infrared ray sensor or the like in which a projector and a receiver are disposed to oppose each other. It is permissible to configurate to determine that the element coupling condition is in the abnormal condition when the receiver receives a beam longer than a predetermined time, depending on installation height of the projector and receiver. Needless to say, the detection style is not restricted to the above-described direct transmission type but a direct reflection type comprising projecting and receiving portions may be used.

The detecting portion 60 which is the feature portion of the invention includes a determining portion which is disposed in a control portion (not shown) for determining whether or not a deviation in coupling of the element end portions exists by receiving a detection signal from the photo detector 62. When the fastener chain C is stopped, the element position detection member 61 moves between the normal first contact position A of an element E of either right or left element E1, E2 and the abnormal second contact position B which is deviated from the first contact position A.

When the element end portion of the carried fastener chain C reaches a predetermined position above the detecting portion 60, an operation instruction is dispatched from the control portion (not shown) after receiving its detection signal so that the feeding gripper 1 stops moving. The first cylinder 63 is located at a waiting position below the chain carrying path when the detecting portion 60 is not activated and begins to rise up toward the bottom face of the fastener chain C before the second cylinder 65 rises up. If the first cylinder 63 rises for a specified distance, the second cylinder 65 is actuated so that the element position detection member 61 fixed on the rod end of the second cylinder 65 rises up toward the first contact position A. Needless to say, the first and second cylinders 63, 65 may begin to rise up at the same time.

Because the first contact position A is set up preliminarily, the moving range of the element position detection member 61 is not changed when the coupling condition of the element rows in the fastener chain C is in the normal condition. As shown in FIG. 6, the contact face of the element position detection member 61 makes a contact with a bottom face of a core thread portion BP adjacent a coupling end of the element row ER1. The moving range of the element position detection member 61 between the first contact position A and the second contact position B is within a predetermined range as shown in FIG. 5 and the detecting face of the photo detector 62 opposes a plate face of the horizontal portion 61*b* of the element position detection member 61. At this time, the photo detector 62 generates an output and the detection signal is output to the control portion (not shown). The determining portion in the control portion determines that the element E1 is not deviated in coupling.

On the other hand, if the right element E1 (upper side in FIG. 7) coupled adjacent an upstream end of the space in the fastener chain C is in such an abnormal condition that it is deviated by the pitch P of a single element, the contact face of the element position detection member 61 makes a contact with a bottom face of part of the coupling end of the element row ER1 halfway of its moving, thereby blocking the element position detection member 61 from moving to the first contact position A. If a deviation in coupling exists in part of the element end portion like this, the element position detection member 61 does not reach the first contact position A but stops at the second contact position B. Therefore, the detecting face of the photo detector 62 does not oppose the plate face of the vertically erected portion 61*a* of the element position detection member 61.

After a predetermined interval of time elapses, the determining portion of the control portion determines that there is an abnormality which hampers normal production of the fastener chain C. If there is a deviation in coupling of the elements E like this, a mark is given by a well-known marking device (not shown) before the product is sent to a next step. If the detection of the deviation in coupling of the elements E is completed, the first and second cylinders 63, 65 are returned to the waiting position below the chain carrying path and all the operation is stopped. After detecting the deviation in coupling of the elements is completed, the fastener chain C is transferred to the stopper attaching portion 40 which is the next step and a required processing work is carried out continuously as described above.

The detected fastener chain may be discharged out of the process through, for example, a chain discharge conveyor instead of the provision of the marking device. In this case, a defective chain loaded on the chain discharge conveyor may be discharged out of the process by spouting air from an air nozzle disposed in the vicinity of the chain discharge conveyor or by activating a discharge bar fixed on a fluid pressure cylinder.

During transportation of the continuous slide fastener chain C through the finish processing portions 10 to 50, detection of the coupling condition of the element rows is executed intermittently without a troublesome work for detecting an abnormality in the elements with the naked eye and an object to be detected is specified securely such that an influence of noise or the like is minimized, thereby obtaining an extremely highly reliable detection result. Further, the fastener chain can be carried effectively throughout the finish processing portions 10 to 50, thereby improving work efficiency, increasing productivity, decreasing production cost and reducing load on workers.

Figure 8:
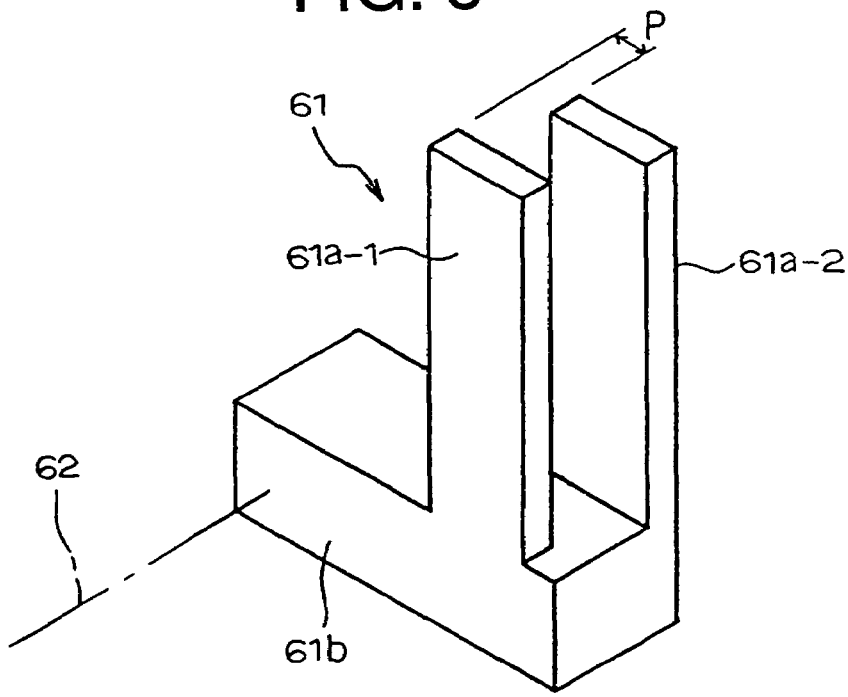
FIG. 8 is a perspective view showing a modification of the element position detection member.

FIG. 8 shows a modification of the element position detection member 61. The element position detection member 61 applied to the first embodiment performs mechanical detection of a deviation in coupling with respect to one element E of any one of right or left element rows ER1, ER2 which are coupled with each other normally when the fastener chain C is stopped. However, the invention is not restricted to this example but the element position detection member 61 can mechanically detect at the same time whether or not there are both elements E1, E2 of right and left element rows ER1, WR2 which are coupled normally.

Referring to FIG. 8, the element position detection member 61 has first and second vertically erected portions 61*a*-1, 61*a*-2, which are formed in pair along a length direction on both right and left sides in the width direction on a front end portion of a top face of the horizontal portion 61*b* in the downstream side of the chain. The respective vertically erected portions 61*a*-1, 61*a*-2 are constructed as first and second detection member and formed in the same structure. The top ends of the respective vertically erected portions 61*a*-1, 61*a*-2 have horizontal faces of the same height and these horizontal faces form contact faces which make contact with the bottom face of the core thread portion BP of the fastener chain C while striding over an opening in the fastener chain C. The respective vertically erected portions 61*a*-1, 61*a*-2 are provided with a gap between them so that they can contact the right and left elements E1, E2 of the fastener chain C and detect the coupling condition between the right and left element rows ER1, ER2. Thus, the horizontal portion 61*b* is constructed of a rectangular block member and the first vertically erected portion 61*a*-1 is disposed nearer the upstream side such that it is deviated from the second vertically erected portion 61*a*-2 by the pitch P of a single element.

The first and second vertically erected portions 61*a*-1, 61*a*-2 rise up to the contact positions on bottom faces of the right and left elements E1, E2 which are stopped at the detecting position from the waiting position below the chain carrying path together. This modification may use the photo detector 62 like the first embodiment. Its projector and receiver are disposed with a predetermined gap between them interposing the element position detection member 61 such that their detecting faces are disposed in the same direction so as to oppose the plate faces of the horizontal portion 61*b*.

Figure 9:
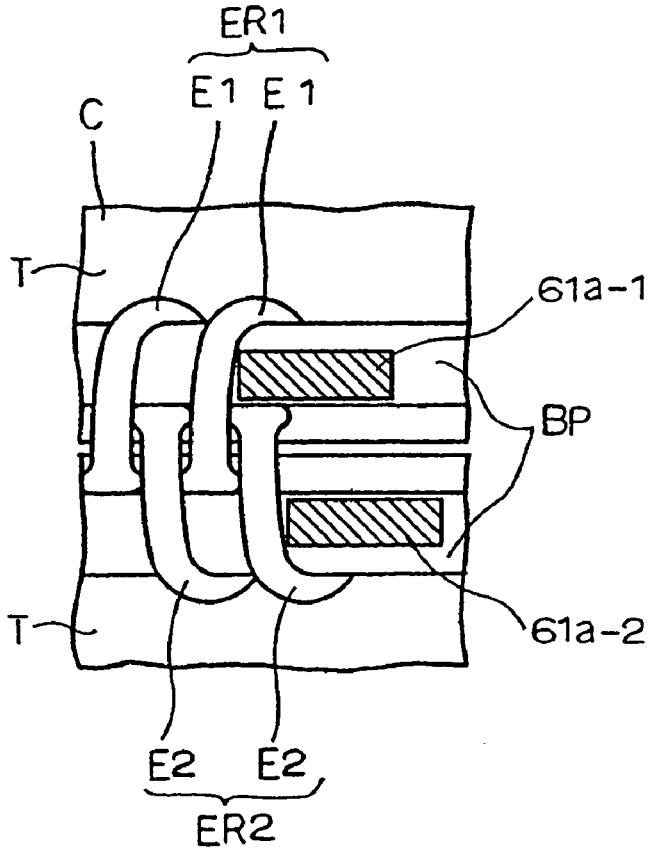
FIG. 9 is a partially enlarged plan view for explaining a condition in which the element position detection member is kept in contact with slide fastener element rows in a normal state.

Because the configuration according to the above-described modification makes the first and second vertically erected portions 61*a*-1, 61*a*-2 rise up to the contact positions of the right and left elements E1, E2 stopped at the detecting position from the waiting position below the chain carrying path when the fastener chain C is stopped, presence/absence of a deviation in coupling of the right and left elements E1, E2 can be detected mechanically at the same time. FIG. 9 shows a state in which the respective vertically erected portions make contact with the right and left element rows ER1, ER2 in the normal condition.

Therefore, by actuating the respective vertically erected portions 61*a*-1, 61*a*-2 together, whether or not there are right and left elements E1, E2 can be detected further securely based on relation of the stop position between the right and left elements E1, E2 preliminarily set. Consequently, whether or not the right and left elements E1, E2 are coupled with each other normally is determined thereby achieving a quick and accurate detection. Further, the structure of the detecting portion 60 can adopt a simple structure as shown in FIG. 8, thereby preventing the structure from being complicated and enlarged, which leads to a large-scale reduction in cost such as equipment cost.

Figure 10:
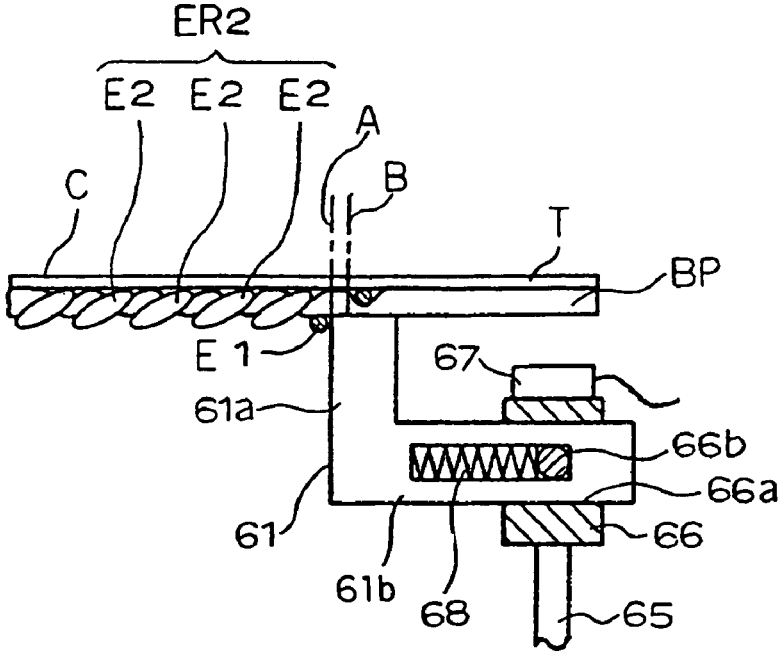
FIG. 10 is a perspective view of major components according to another embodiment of the detecting device.

FIG. 10 shows a second embodiment of the detecting portion 60 applied to the invention. Referring to the FIG. 10, the detecting portion 60 of the second embodiment differs from the first embodiment in that the element position detection member 61 waits at the first contact position A where the coupling end of the element row ER1 is in the preliminarily set normal condition before the fastener chain C is stopped. In the detecting portion 60 in the second embodiment, same reference numerals and names are given to substantially same components as those of the detecting portion of the first embodiment. The second embodiment also enables the element position detection member 61 shown in the figure to move between the first and second contact positions A, B of the right and left elements E1, E2 by means of single moving means at the same time.

Referring to the figure, the element position detection member 61 is comprised of the vertically erected portion 61*a* which makes contact with the element end portion of the element row ER1 of the fastener chain C and the horizontal portion 61*b* which is extended horizontally from the bottom end of the vertically erected portion 61*a* toward the downstream of the chain. The front end portion of the horizontal portion 61*b* in the downstream side of the chain is supported freely slidably by a second bracket 66 fixed on the rod end of the second cylinder 65 which is actuated independently in the same direction as the operating direction of the first cylinder (not shown). A proximity switch 67 which is a detector for detecting the moving range of the element position detection member 61 at a fixed position is provided on a top face of the bracket 66. According to the second embodiment, the second cylinder 65, the element position detection member 61 and the proximity switch 67 are also assembled on a common support member like the first embodiment so as to form a unit.

A through hole 66*a* which goes through horizontally in a chain introduction direction is formed inside the bracket 66 and a supporting pin 66*b* which is fit to a sliding hole 61*b*-1 formed in the horizontal portion 61*b* of the element position detection member 61 is provided protrudedly in a direction intersecting the chain introduction direction inside the through hole 66*a*. The horizontal portion 61*b* is inserted into the inside of the bracket 66 slidably via this supporting pin 66*b* in defiance of an elasticity of a compression coil spring 68. The horizontal portion 61*b* is guided into and supported inside the bracket 66 and slid toward the downstream of the chain with elastically abutting against the element end portion face of the fastener chain C sent from the slider inserting portions 30*a*, 30*b*.

Therefore, the vertically erected portion 61*a* advances/retracts elastically between the normal first contact position A and the abnormal second contact position B. The element position detection member 61 advances or retracts smoothly for a predetermined distance corresponding to timing without any special driving source. Because the element position detection member 61 slides elastically within the bracket 66, the posture of the element position detection member does not change during the detection and the element position detection member 61 can make a contact with the element end portion face with a right posture to achieve a stabilized detection.

Before the coupling end of the element row ER of the carried fastener chain C reaches the predetermined position above the detecting portion 60, the first cylinder (not shown) and the second cylinder 65 are controlled and driven based on an instruction signal from the control portion (not shown) so as to move the element position detection member 61 to the first contact position A below the chain carrying path, which is a waiting position.

Now, the fastener chain C is carried to the detecting portion 60 keeping substantially the same height as the first contact position. If the end face of the element E1 of the element row ER1 collides with the element position detection member 61 elastically, the element position detection member 61 moves from the first contact position to the second contact position in defiance of the elastic force of the compression coil spring 68. When the element position detection member 61 moves to the second contact position B and is detected by the proximity switch 67, a detection signal of the proximity switch 67 is sent to the control portion (not shown). This control portion calculates after receiving an output signal from the proximity switch 67 and if its detection value exceeds a predetermined value, it is determined that a deviation in coupling of the element on the element row ER1 exists. Corresponding to determination that the deviation in coupling of the element E1 exists, the fastener chain is provided with a mark by a well-known marking device (not shown) in the above-described manner before it is sent to a next step.

Distance between the first and second contact positions A, B may be set freely along the chain carrying path. Changing this distance enables the element position detection member 61 to be moved securely and stably and the coupling end of the element row ER1 to be detected accurately and smoothly depending on the length of the fastener chain C carried along the chain carrying path. Further, working cost and equipment cost can be reduced largely without delay in production time.

According to the second embodiment, the first contact position A is preliminarily set up. The element position detection member 61 stops at the first contact position A if the coupling condition of the element row ER1 of the fastener chain C is in the normal condition and its moving range is not changed. If the detection of the deviation in coupling of the element E1 at the coupling end of the element row ER1 is completed, the second cylinder 65 is returned to the waiting position below the chain carrying path and all the operations stop. Then, the fastener chain C is carried to the stopper attaching portion 40, which is a next step.

Although, in the above-described respective embodiments, a case where the apparatus of the invention is disposed in series on the chain carrying path of the fastener chain finishing apparatus has been explained, the apparatus of the invention is not restricted to the respective embodiments and their modifications. The coupling condition of the right and left elements may be detected mechanically after the fastener chain C passes the various kinds of finish processing portions and the apparatus of the invention may be applied to slide fastener product completed in such a manner. The invention naturally includes a technical scope which those skilled in the art can achieve from the above-described respective embodiments and modifications.

What is claimed is:

1. An element coupling condition detecting device for slide fastener element rows which is disposed at a carrying path of a fastener chain for detecting a coupling of right and left elements located adjacent an end of a space in the fastener chain where the elements are missing, wherein the device comprises:

a chain stopping means for stopping transportation of the fastener chain at a detecting position of the right and left elements; and a detecting portion having a mechanical detecting means for detecting presence/absence of a deviation in coupling of the right and left elements when the fastener chain is stopped.

2. The element coupling condition detecting device according to claim 1, wherein the detecting portion comprises:

an element position detection member which moves between a preliminarily set first contact position of at least one element of the right and left elements and a second contact position deviated from the first contact position, when the fastener chain is stopped; and a determining portion which determines that it is normal when the element position detection member exists at the first contact position while it determines that it is abnormal when the element position detection member exists at the second contact position.

3. The element coupling condition detecting device according to claim 2, wherein the element position detection member is constituted of a first detection member and a second detection member provided with a gap between them so that the first and second detection members can contact the right and left elements while the first detection member is disposed in an upstream of the fastener chain with respect to the second detection member such that they are deviated by a pitch of a single element.

4. The element coupling condition detecting device according to claim 2, wherein the element position detection member has first and second moving means capable of advancing/retracting with respect to the first contact position.

5. The element coupling condition detecting device according to claim 4, further comprising a photoelectric detector for detecting an advancement/retraction position of the element position detection member when the element position detection member advances/retracts.

6. The element coupling condition detecting device according to claim 2, wherein the element position detection member is constituted to wait at the first contact position before the fastener chain is stopped and to be movable between the first and second contact positions.

7. The element coupling condition detecting device according to claim 6, further comprising a proximity switch for detecting a moving position of the element position detection member when the element position detection member moves between the first and second contact positions.

* * * * *

UNITED STATES PATENT AND TRADEMARK OFFICE

CERTIFICATE OF CORRECTION

PATENT NO. : 7,334,322 B2
APPLICATION NO. : 10/828733
DATED : February 26, 2008
INVENTOR(S) : Kameda et al.

It is certified that error appears in the above-identified patent and that said Letters Patent is hereby corrected as shown below:

Title page,

Item (57), ABSTRACT, the ABSTRACT should read,

--A coupling condition detecting device for element rows of a slide fastener has a chain stopper for stopping a chain at a detecting position of coupling right and left elements adjacent an upstream end of a space in the chain. A detecting portion having a mechanical detector for detecting presence/absence of a deviation in coupling of the elements is provided at the detecting position. The detecting portion has an element position detection member movable between a normal first contact position where the detection member does not contact any elements and an abnormal second contact position where it contacts an element. When the detection member exists at the first contact position when the chain is stopped, it is determined that the coupling is normal and when the detection member exists at the second contact position, it is determined that the coupling is abnormal.--.

Signed and Sealed this

Fifteenth Day of July, 2008

JON W. DUDAS
*Director of the United States Patent and Trademark Office*